US009114517B2

(12) United States Patent
Wang

(10) Patent No.: US 9,114,517 B2
(45) Date of Patent: Aug. 25, 2015

(54) NAILING DEVICE ADAPTED FOR NAIL UNITS OF DIFFERENT SIZES

(75) Inventor: Rong-Yu Wang, Taichung (TW)

(73) Assignee: Apex Mfg. Co., Ltd., Taichung (TW)

( * ) Notice: Subject to any disclaimer, the term of this patent is extended or adjusted under 35 U.S.C. 154(b) by 625 days.

(21) Appl. No.: 13/429,194

(22) Filed: Mar. 23, 2012

(65) Prior Publication Data

US 2012/0181320 A1 Jul. 19, 2012

Related U.S. Application Data

(63) Continuation-in-part of application No. 12/692,589, filed on Jan. 23, 2010, now abandoned.

(30) Foreign Application Priority Data

Jan. 8, 2010 (TW) ..... 99100353 A

(51) Int. Cl.

| | |
|---|---|
| ***B25C 5/00*** | (2006.01) |
| ***B25C 5/08*** | (2006.01) |
| ***B25C 5/11*** | (2006.01) |
| ***B25C 5/16*** | (2006.01) |

(52) U.S. Cl.
CPC ... *B25C 5/08* (2013.01); *B25C 5/11* (2013.01); *B25C 5/1658* (2013.01)

(58) Field of Classification Search
CPC ..... B25C 5/00; B25C 5/06
USPC ..... 227/120, 109, 139, 135, 146, 175.1
See application file for complete search history.

(56) References Cited

U.S. PATENT DOCUMENTS

| | | | | | |
|---|---|---|---|---|---|
| 2,525,444 | A * | 10/1950 | Bowers | ..... | 174/86 |
| 2,528,444 | A | 10/1950 | Marano | | |
| 3,958,738 | A * | 5/1976 | Tremblay | ..... | 227/109 |
| 5,009,356 | A * | 4/1991 | Chang | ..... | 227/120 |
| 2009/0045238 | A1 * | 2/2009 | Melgaard et al. | ..... | 227/120 |

FOREIGN PATENT DOCUMENTS

| | | |
|---|---|---|
| TW | I271286 | 1/2007 |

* cited by examiner

*Primary Examiner* — Nathaniel Chukwurah
(74) *Attorney, Agent, or Firm* — Muncy, Geissler, Olds & Lowe, P.C.

(57) ABSTRACT

A nailing device of the present invention includes a main body, a magazine and a nail pusher. The magazine is disposed in the main body for nail units to be seated thereon. The nail pusher is slidably straddled on the magazine to push the nail units forward. The nail pusher has a first side and a second side. Two slanted guiding portions are frontward and outward extended from the two sides respectively, so that the two slanted guiding portions diverge toward a direction nail units being pushed forward. The slanted guiding portions have two guiding surfaces facing each other to guide and position staples, so that centers of different staples of different sizes can locate at the same position.

6 Claims, 6 Drawing Sheets

NAILING DEVICE ADAPTED FOR NAIL UNITS OF DIFFERENT SIZES

FIELD OF THE INVENTION

The present invention is a continuation-in-part of application Ser. No. 12/692,589, filed Jan. 23, 2010 now abandoned, the entire contents of which are hereby incorporated by reference.

BACKGROUND OF THE INVENTION

Description of the Prior Art

A nailing device is commonly used to nail a nail unit into an object, and the nailing device has a magazine to receive the nail unit(s). In an Applicant's patent TW 1271286 prior granted by Taiwan Patent Office, a nailing device is provided to guide and position nail units of different sizes. The nailing device has a nail guider (25) formed with a nail guiding portion (253), so as to push the nail units toward a side opposite to the nail guiding portion (253). Thereby, the nail guider is adapted to push nail units of different sizes.

However, such single-sided disposal of the nail guider will cause nail units of different sizes to offset from the center of the nailing device. Thus the user will have trouble aiming, and the nail unit may be nailed into a position slightly offset from the desired one.

On the other hand, a staple gun for accommodating staples in different sizes is disclosed in patent U.S. Pat. No. 3,958,738. A leaf spring is disposed at each of the opposite inner sides of the magazine base, so that the staples can be clamped by the two leaf springs. Thus, staples which are slightly different in size can be employed in a staple gun. However, larger staples are difficult to be received between the two leaf springs. Moreover, T-shaped nail units are impossible to be employed in the staple gun disclosed in patent U.S. Pat. No. 3,958,738.

The present invention is, therefore, arisen to obviate or at least mitigate the above mentioned disadvantages.

SUMMARY OF THE INVENTION

The main object of the present invention is to provide a nailing device adapted for nail units of different sizes.

Another main object of the present invention is to provide a nailing device that can locate centers of different nail units of different sizes at the same position.

To achieve the above and other objects, the nailing device of the present invention includes a main body, a magazine and a nail pusher. The magazine is disposed in the main body for nail units to be seated thereon. The nail pusher is slidably straddled on the magazine to push the nail units forward. The nail pusher has a first side and a second side. Two slanted guiding portions are frontward and outward extended from the two sides respectively, so that the two slanted guiding portions diverge toward a direction the nail units being pushed forward. The slanted guiding portions have two guiding surfaces facing each other to guide and position staples, so that centers of different staples of different sizes can locate at the same position.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
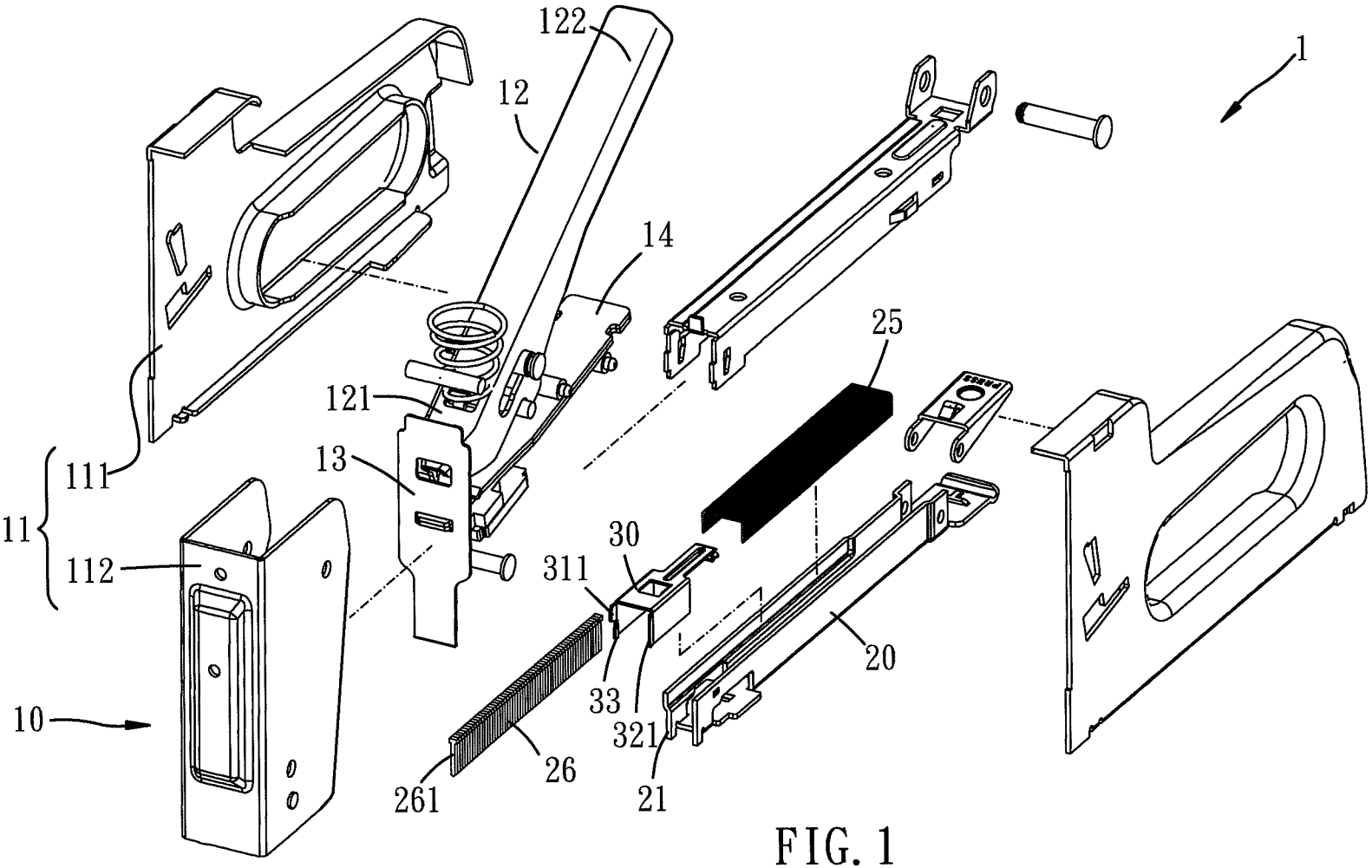
FIG. 1 is a breakdown drawing showing a nailing device of the present invention.

Please refer to FIG. 1. The nailing device 1 of the present invention mainly includes a main body 10, a magazine 20 and a nail pusher 30.

Figure 2:
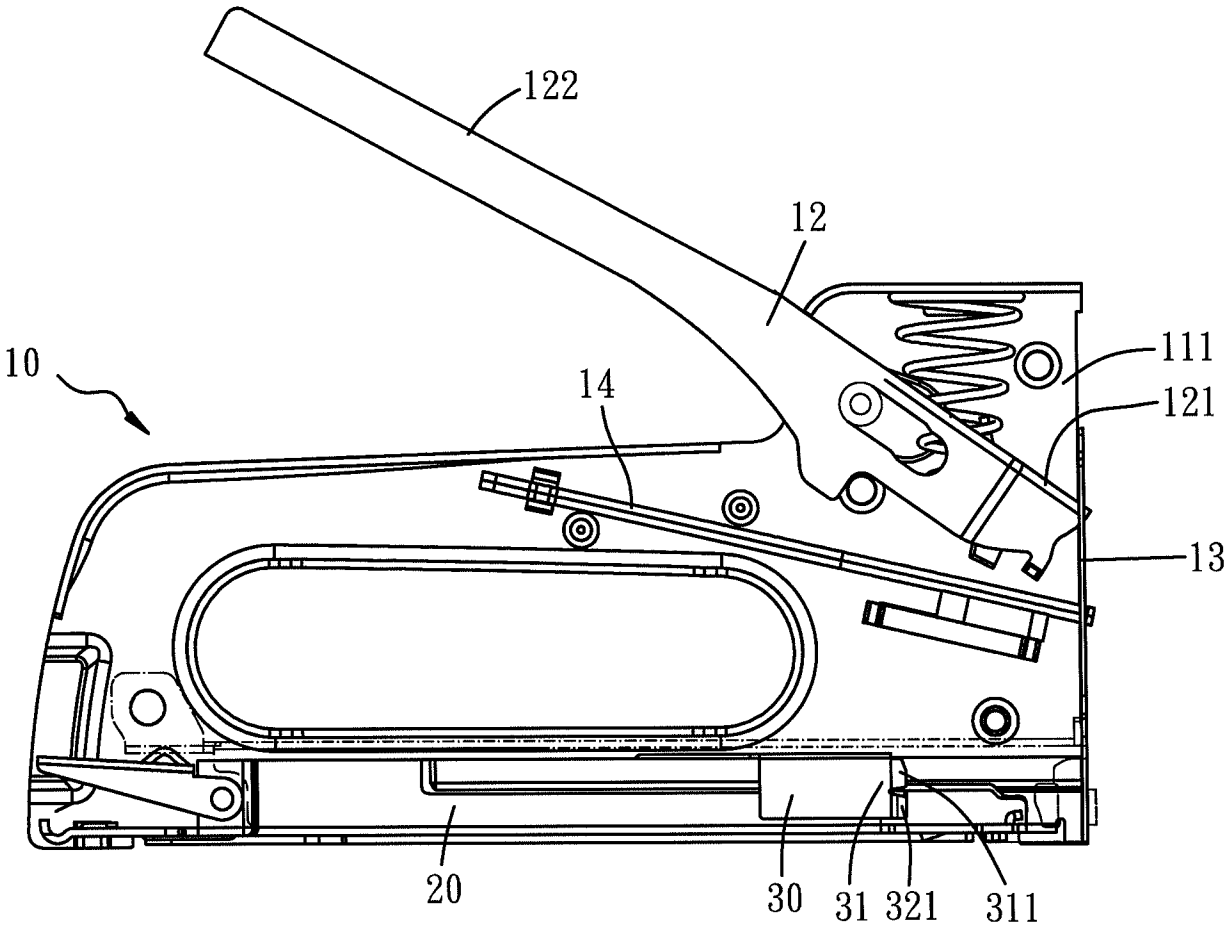
FIG. 2 is a side view showing a part of a nailing device of the present invention.

Please refer to FIGS. 1 and 2. The main body 10 has a shell 11, an actuator 12, a striker 13 and a leaf spring 14. The shell 11 may consists of two side plates 111 and a front plate 112 and defines a chamber therein. The actuator 12 is pivotably disposed on the shell 11 and has a driving end 121 inserted into the chamber and a pressing end 122 extended out of the chamber. The striker 13 stands in the front of the chamber and is driven up and down by the driving end 121. The leaf spring 14 mounts with the striker 13 at one end thereof, and the leaf spring 14 provides the striker 13 an elastic force to strike nail units out of the chamber.

Figure 3:
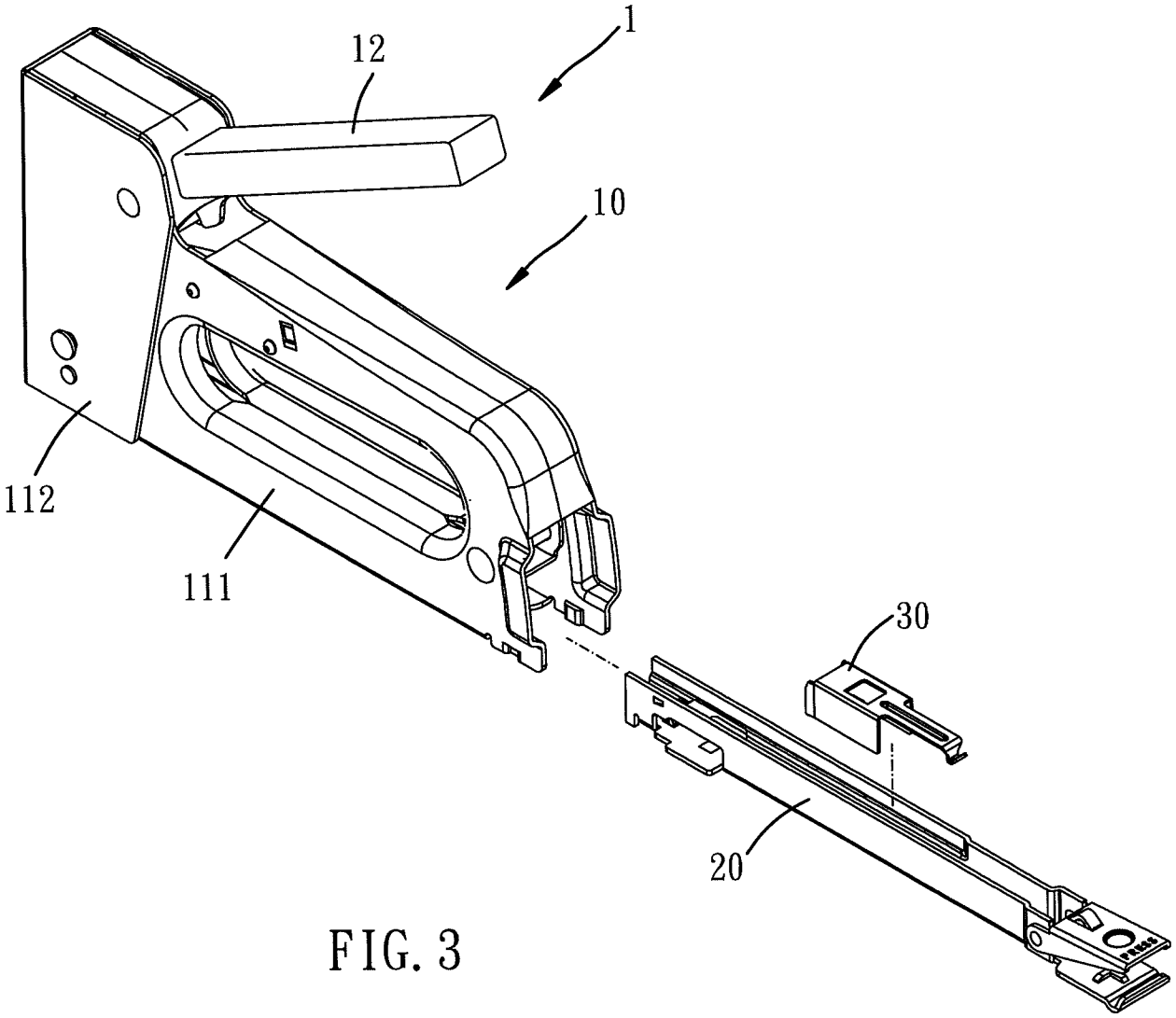
FIG. 3 is a combination drawing showing a nailing device of the present invention.
Figure 4:
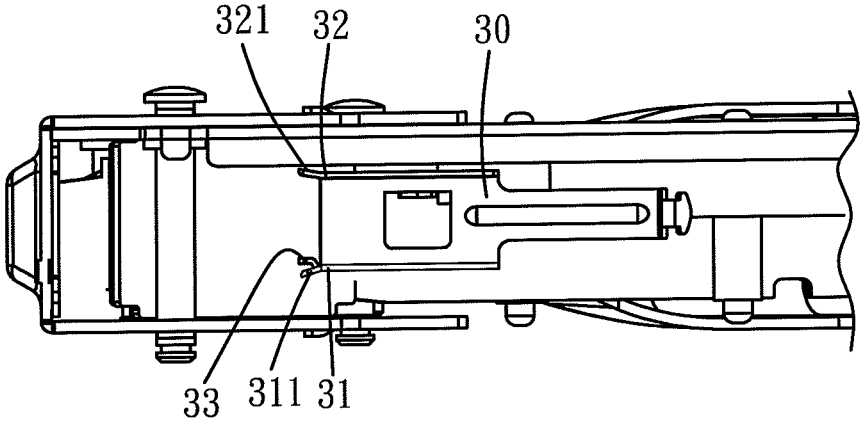
FIG. 4 is a bottom view showing a part of the nailing device of the present invention.

Please refer to FIGS. 1 to 3. The magazine 20 is disposed in the main body 10, i.e. the chamber. Preferably, the magazine 20 is slidably disposed at a bottom of the chamber. The magazine is adapted for the nail units to straddle thereon. The nail units may be staples 25 or T-shaped nail units (or so called nails) 26. The staples 25 can be straddled on the magazine 20, and the T-shaped nail units 26 can stand at a side of the magazine 20.

Please refer to FIGS. 1 and 4-6. The nail pusher 30 is slidably disposed on the magazine 20 to push the nail units forward. Preferably, a resilient member (not shown) is disposed between the magazine 20 and the nail pusher 30, so as to provide the nail pusher 30 with an elastic force to move the nail pusher 30 forward. The nail pusher 30 has a first side 31 and a second side 32. Two slanted guiding portions 311, 321 are frontward and outward extended from the two sides 31, 32 respectively, so that the two slanted guiding portions 311, 322 diverge toward a direction the nail units being pushed forward. The slanted guiding portions 311, 321 have two guiding surfaces 312, 322 facing each other. The guiding surfaces 312, 322 are thus guide and position the staples 25, so that centers of different staples 25 of different sizes can locate at the same position, which makes aiming facile for the user.

Furthermore, in order to guide the T-shaped nail units 26, the first side 31 of the nail pusher 30 is formed with an auxiliary guiding portion 33 located beneath the slanted guiding portion 311 of the same side 31. The auxiliary guiding portion 33 is extended frontward and outward from the first side 31. More specifically, the auxiliary guiding portion 33 has a slanted section 331 and a nail contacting section 332. The slanted section 331 connects between the nail contacting section 332 with the first side 31 of the nail pusher 30. The slanted section 331 is frontward and inward extended from the first side 31 of the nail pusher 30, and the nail contacting section 332 is substantially extended frontward and has an outer surface 333 for a feet 261 of the T-shaped nail unit 26 to lean against. Preferably, the nail contacting section 332 may be more protrusive frontward than the slanted guiding portion 331.

Figure 6:
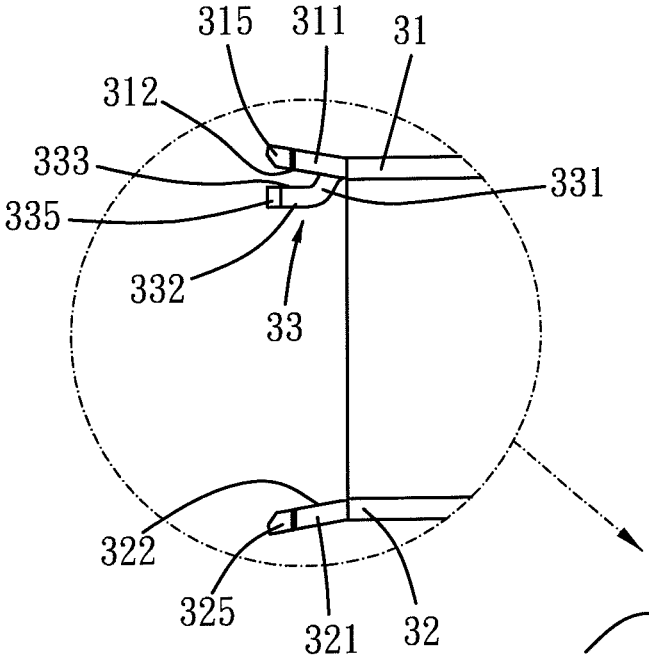
FIG. 6 is a top view showing a part of the nail pusher of the present invention.
Figure 5:
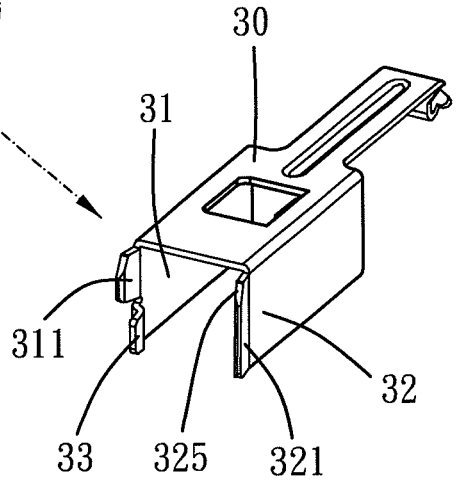
FIG. 5 is a perspective drawing showing a nail pusher of the present invention.
Figure 7:
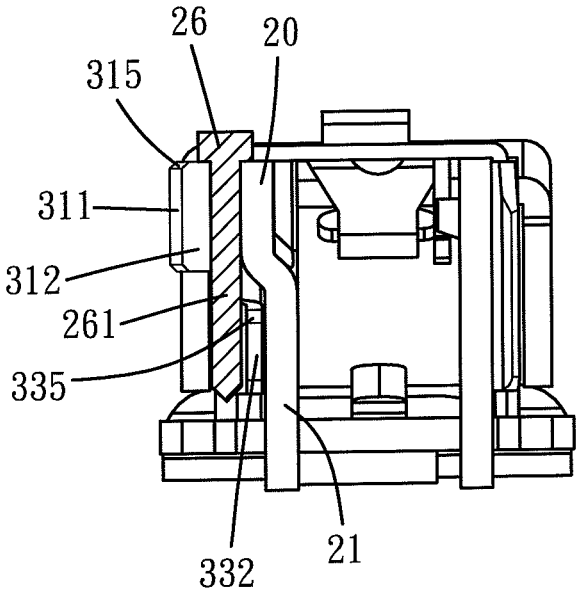
FIG. 7 is a profile showing a magazine and a nail pusher of the present invention.

Please refer to FIGS. 1 and 7. The magazine 20 is formed with a guiding slot 21 corresponding to the auxiliary guiding portion 33. The auxiliary guiding portion 33 can thus slide back and forth along the guiding slot 21. As shown in FIGS. 5 and 6, each of the slanted guiding portions 311, 321 and the auxiliary guiding portion 33 is formed with a chamfer 315, 325, 335, which may be a plane or a curve surface, at a top corner thereof. As a result, even if any of the slanted guiding portions 311, 321 and the auxiliary guiding portion 33 are struck by the striker 13, the chamfers 315, 325, 335 will bear the striking force and form a horizontal component force to rebound the nail pusher 30 backward, so as not to block the travel of the striker 13.

Figure 8:
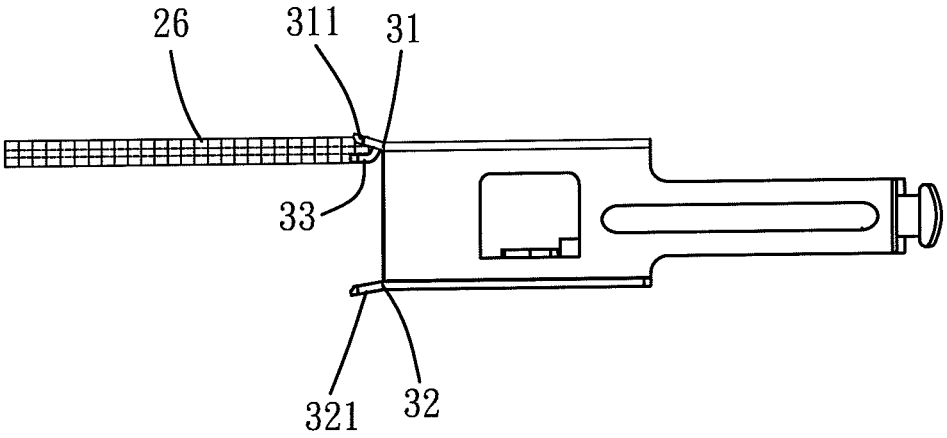
FIG. 8 is a top view showing a nail pusher of the present invention pushing T-shaped nail units.

Please refer to FIGS. 7 and 8. When the T-shaped nail units 26 are disposed in the magazine, the foot/feet 261 of at least one of the T-shaped nail units 26 can lean against the auxiliary guiding portion 33 so that the T-shaped nail units 26 can stand upright. As a result, the risk of jam of the nail units 26 in the magazine will be considerably lowered. The slanted guiding portion 311 can be used to push the T-shaped nail units 26 under such circumstance.

Figure 9:
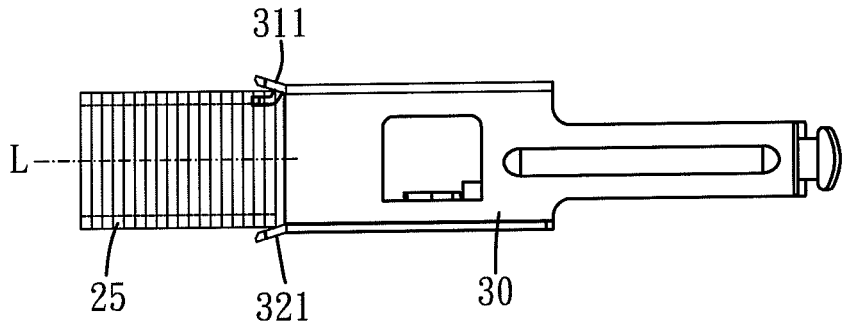
FIG. 9 is a top view showing a nail pusher of the present invention pushing staples of smaller size.
Figure 10:
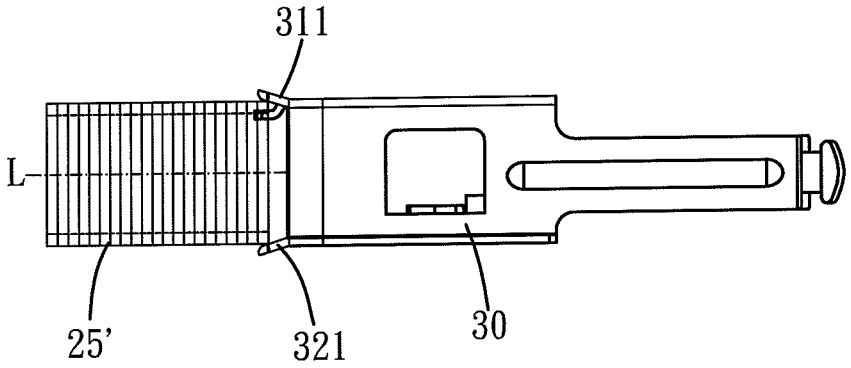
FIG. 10 is a top view showing a nail pusher of the present invention pushing staples of bigger size.

Please refer to FIGS. 9 and 10 next. When the staples 25, 25' are disposed in the magazine 20, the guiding surfaces 312, 322 can guide the staples 25, 25' of different sizes and position centers of the staples 25, 25' at the same position, i.e. all the centers thereof lies on the central line L. As such, it is easier for the user to aim while nailing so that the staples can be nailed at desired positions.

In summarization, the present invention provides two guiding surface that is adapted for staples of different sizes, so as to further achieve the aiming purpose. In addition, the disposal of the auxiliary guiding portion helps guide the T-shaped nail units to stand upright, such that the T-shaped nail units will not be inclined nor be jammed in the magazine.

What is claimed is:

1. A nailing device adapted for nail units of different sizes, comprising:

a main body;

a magazine, disposed in the main body, the nail units being seated on the magazine;

a nail pusher, slidably straddled on the magazine to push the nail units forward along a pushing direction, the nail pusher having a first side wall and a second side wall which are both vertical, each of the first side wall and the second side wall having a front face which is vertical and is perpendicular to the pushing direction, two slanted guiding portions being frontward and outward extended from the front faces of the two side walls respectively, the two slanted guiding portions divergedly extending toward two sides of the pushing direction, each slanted guiding portion having a distal end which is located in front of the front faces of the side walls, distance between the two distal ends being larger than distance between the two front faces of the side walls, the slanted guiding portions having two guiding surfaces facing each other to guide and position staples, so that centers of different staples of different sizes can locate at the same position.

2. The nailing device of claim 1, wherein the first side of the nail pusher is further formed with an auxiliary guiding portion located beneath the slanted guiding portion of the same side, the auxiliary guiding portion is extended frontward and inward from the first side, the auxiliary guiding portion has an outer surface for a foot of a T-shaped nail unit to lean against.

3. The nailing device of claim 2, wherein a chamfer is formed at a top corner of each slanted guiding portion, and a chamber is formed at a top corner of the auxiliary guiding portion.

4. The nailing device of claim 2, wherein the magazine is formed with a guiding slot corresponding to the auxiliary guiding portion, the auxiliary guiding portion can slide back and forth along the guiding slot.

5. The nailing device of claim 2, wherein the auxiliary guiding portion having a slanted section and a nail contacting section, the slanted section connects between the nail contacting section with the first side of the nail pusher, the slanted section is frontward and inward extended from the first side of the nail pusher, and the nail contacting section is substantially extended frontward, the outer surface is defined on the nail contacting section.

6. The nailing device of claim 1, wherein a chamfer is formed at a top corner of each slanted guiding portion.

* * * * *